US009396872B2

(12) United States Patent
Inoue et al.

(10) Patent No.: US 9,396,872 B2
(45) Date of Patent: Jul. 19, 2016

(54) GRAIN ORIENTED ELECTRICAL STEEL SHEET AND METHOD FOR MANUFACTURING THE SAME

(75) Inventors: Hirotaka Inoue, Tokyo (JP); Takeshi Omura, Tokyo (JP); Hiroi Yamaguchi, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 697 days.

(21) Appl. No.: 13/814,675

(22) PCT Filed: Aug. 5, 2011

(86) PCT No.: PCT/JP2011/004471

§ 371 (c)(1),
(2), (4) Date: Feb. 6, 2013

(87) PCT Pub. No.: WO2012/017689

PCT Pub. Date: Feb. 9, 2012

(65) Prior Publication Data

US 2013/0129985 A1 May 23, 2013

(30) Foreign Application Priority Data

Aug. 6, 2010 (JP) ..... 2010-178080

(51) Int. Cl.
*H01F 41/00* (2006.01)
*C22C 38/00* (2006.01)
(Continued)

(52) U.S. Cl.
CPC ..... *H01F 41/00* (2013.01); *C21D 8/1216* (2013.01); *C21D 9/46* (2013.01); *C22C 38/001* (2013.01);
(Continued)

(58) Field of Classification Search
CPC ..... C22C 38/00–38/60; Y10T 428/2457; Y10T 428/24612
See application file for complete search history.

(56) References Cited

U.S. PATENT DOCUMENTS 5,961,744 A * 10/1999 Yamazaki ..... C21D 8/1288 148/111
6,280,862 B1 * 8/2001 Inokuti ..... C21D 8/1288 148/110
(Continued)

FOREIGN PATENT DOCUMENTS

CN 1331348 1/2002
JP 57-002252 B2 1/1982
(Continued)

OTHER PUBLICATIONS

Japanese Notification of Reasons for Refusal dispatched Aug. 19, 2014 along with an English translation from corresponding Japanese Patent Application No. 2010-178080.
(Continued)

*Primary Examiner* — Donald J Loney

(57) ABSTRACT

A grain oriented electrical steel sheet may reduce iron loss of material with linear grooves formed thereon for magnetic domain refinement and offer excellent low iron loss properties when assembled as an actual transformer, where the steel sheet has sheet thickness of 0.30 mm or less, linear grooves are formed at intervals of 2-10 mm in the rolling direction, the depth of each of the linear grooves is 10 μm or more, the thickness of the forsterite film at bottom portions of the linear grooves is 0.3 μm or more, total tension applied to the steel sheet by the forsterite film and tension coating is 10.0 MPa or higher in rolling direction, and the proportion of eddy current loss in iron loss $W_{17/50}$ of the steel sheet is 65% or less when alternating magnetic field of 1.7 T and 50 Hz is applied to the steel sheet in the rolling direction.

1 Claim, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/60*** | (2006.01) |
| ***C23C 30/00*** | (2006.01) |
| ***H01F 1/18*** | (2006.01) |
| ***C23C 26/00*** | (2006.01) |
| ***C21D 8/12*** | (2006.01) |
| ***C21D 9/46*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/08* (2013.01); *C22C 38/60* (2013.01); *C23C 26/00* (2013.01); *C23C 30/00* (2013.01); *H01F 1/18* (2013.01); *Y10T 428/2457* (2015.01); *Y10T 428/24612* (2015.01)

(56) References Cited

U.S. PATENT DOCUMENTS

2002/0000261 A1* 1/2002 Fujikura ..... C21D 8/1288 148/121

2005/0112377 A1* 5/2005 Schuhmacher ..... C21D 8/1288 428/408

FOREIGN PATENT DOCUMENTS

| | | | |
|---|---|---|---|
| JP | 62-053579 | B2 | 11/1987 |
| JP | 63-125620 | A | 5/1988 |
| JP | 9-157748 | A | 6/1997 |
| JP | 2000-045052 | A | 2/2000 |
| JP | 2001-303137 | A | 10/2001 |
| JP | 2002-356750 | A | 12/2002 |
| JP | 2009-235472 | A | 10/2009 |
| JP | 2009-235473 | A | 10/2009 |

OTHER PUBLICATIONS

Chinese Office Action dated Dec. 12, 2014 along with an English translation from corresponding Chinese Patent Application No. 201180038848.8.

Chinese Official Action dated Jun. 10, 2014 (including an English translation) from corresponding Chinese Patent Application No. 201180038848.8.

Canadian Official Action dated May 23, 2014 from corresponding Canadian Patent Application No. 2,807,444.

* cited by examiner

GRAIN ORIENTED ELECTRICAL STEEL SHEET AND METHOD FOR MANUFACTURING THE SAME

RELATED APPLICATIONS

This is a §371 of International Application No. PCT/JP2011/004471, with an international filing date of Aug. 5, 2011 (WO 2012/017689 A1, published Feb. 9, 2012), which is based on Japanese Patent Application No. 2010-178080, filed Aug. 6, 2010, the subject matter of which is incorporated herein by reference.

TECHNICAL FIELD

This disclosure relates to a grain oriented electrical steel sheet that is used for iron core materials for transformers and so on, and a method for manufacturing the same.

BACKGROUND

Grain oriented electrical steel sheets mainly used as iron cores of transformers are required to have excellent magnetic properties, in particular, less iron loss. To meet this requirement, it is important that secondary recrystallized grains are highly aligned in the steel sheet in the (110)[001] orientation (or so-called Goss orientation) and impurities in the product steel sheet are reduced. However, there are limitations in controlling crystal orientation and reducing impurities in terms of balancing with manufacturing cost, and so on. Therefore, some techniques have been developed to introduce non-uniformity to the surfaces of a steel sheet in a physical manner and reduce the magnetic domain width for less iron loss, namely, magnetic domain refining techniques.

For example, JP 57-002252 B proposes a technique for reducing iron loss of a steel sheet by irradiating a final product steel sheet with a laser, introducing a high dislocation density region to the surface layer of the steel sheet and reducing the magnetic domain width. In addition, JP 62-053579 B proposes a technique for refining magnetic domains by forming linear grooves having a depth of more than 5 μm on the base iron portion of a steel sheet after final annealing at a load of 882 to 2156 MPa (90 to 220 kgf/mm$^2$), and then subjecting the steel sheet to heat treatment at a temperature of 750° C. or higher. With the development of the above-described magnetic domain refining techniques, grain oriented electrical steel sheets having good iron loss properties may be obtained.

However, the above-mentioned techniques for performing magnetic domain refining treatment by forming linear grooves have a smaller effect on reducing iron loss compared to other magnetic domain refining techniques for introducing high dislocation density regions by laser irradiation and so on. The above-mentioned techniques also have a problem that there is little improvement in the iron loss of an actual transformer assembled, even though iron loss is reduced by magnetic domain refinement. That is, these techniques provide an extremely poor building factor (BF).

It could therefore be helpful to provide a grain oriented electrical steel sheet that may further reduce iron loss of a material with linear grooves formed thereon for magnetic domain refinement and exhibit excellent low iron loss properties when assembled as an actual transformer, along with an advantageous method for manufacturing the same.

SUMMARY

We this provide:

[1] A grain oriented electrical steel sheet comprising: a forsterite film and tension coating on a surface of the steel sheet; and linear grooves for magnetic domain refinement on the surface of the steel sheet, wherein
- the steel sheet has a sheet thickness of 0.30 mm or less,
- the linear grooves are formed at intervals of 2 to 10 mm in a rolling direction,
- a depth of each of the linear grooves is 10 μm or more,
- a thickness of the forsterite film at bottom portions of the linear grooves is 0.3 μm or more,
- a total tension applied to the steel sheet by the forsterite film and the tension coating is 10.0 MPa or higher in the rolling direction, and
- a proportion of eddy current loss in iron loss $W_{17/50}$ of the steel sheet is 65% or less when an alternating magnetic field of 1.7 T and 50 Hz is applied to the steel sheet in the rolling direction.

[2] A method for manufacturing a grain oriented electrical steel sheet, the method comprising:
- subjecting a slab for a grain oriented electrical steel sheet to rolling to be finished to a final sheet thickness;
- subjecting the steel sheet to subsequent decarburization;
- then applying an annealing separator composed mainly of MgO to a surface of the steel sheet before subjecting the steel sheet to final annealing; and
- subjecting the steel sheet to subsequent tension coating and flattening annealing, wherein
  - (1) formation of linear grooves for magnetic domain refinement is performed before the final annealing for forming a forsterite film,
  - (2) the annealing separator has a coating amount of 10.0 g/m$^2$ or more, and
  - (3) tension to be applied to the steel sheet in a flattening annealing line after the final annealing is controlled within a range of 3 to 15 MPa.

[3] The method for manufacturing a grain oriented electrical steel sheet according to item [2] above, wherein the slab for the grain oriented electrical steel sheet is subjected to hot rolling, and optionally, hot band annealing, and subsequently subjected to cold rolling once, or twice or more with intermediate annealing performed therebetween, to be finished to a final sheet thickness.

It is possible to provide a grain oriented electrical steel sheet that allows an actual transformer assembled therefrom to effectively maintain the effect of reducing iron loss of the steel sheet, which has linear grooves formed thereon and has been subjected to magnetic domain refining treatment. Therefore, the actual transformer may exhibit excellent low iron loss properties.

BRIEF DESCRIPTION OF THE DRAWINGS

Our steel sheets and methods will be further described below with reference to the accompanying drawings, wherein.

DETAILED DESCRIPTION

We considered the requirements necessary to improve iron loss properties of a grain oriented electrical steel sheet as a material with linear grooves formed thereon for magnetic domain refinement and having a forsterite film (a film composed mainly of $Mg_2SiO_4$), and to prevent deterioration in the building factor in an actual transformer using that grain oriented electrical steel sheet.

Regarding the produced product sheet samples, the thickness of the forsterite film where linear grooves are formed, the film tension and the proportion of eddy current loss of material are shown in Table 1. It can be seen that film tension increases and proportion of eddy current loss of material decreases as the thickness of the forsterite film where linear grooves are formed increases. In addition, even if the thickness of the forsterite film is small, film tension may be increased by increasing the amount of insulating coating to be applied, which results in a decrease in the proportion of eddy current loss. As used herein, this "insulating coating" means such coating that may apply tension to the steel sheet for the purpose of reducing iron loss (hereinafter, referred to as "tension coating").

TABLE 1

| Sample No. | Thickness of Forsterite Film Where Grooves Are Formed (μm) | Coating Amount of Tension Coating ($g/m^2$) | Film Tension (MPa) | Proportion of Eddy Current Loss (%) | Remarks |
|---|---|---|---|---|---|
| 1 | 0 | 11.0 | 6.0 | 71 | grooves formed on the sheet after final annealing |
| 2 | 0.06 | 11.0 | 7.2 | 70 | — |
| 3 | 0.12 | 11.0 | 8.1 | 68 | — |
| 4 | 0.15 | 11.0 | 8.8 | 68 | — |
| 5 | 0.27 | 11.0 | 9.5 | 66 | — |
| 6 | 0.31 | 11.0 | 10.2 | 65 | — |
| 7 | 0.35 | 11.0 | 11.8 | 63 | — |
| 8 | 0.46 | 11.0 | 13.7 | 61 | — |
| 9 | 0.52 | 11.0 | 15.8 | 60 | — |
| 10 | 0.12 | 18.5 | 12.3 | 63 | thick tension coating |
| 11 | 0.19 | 18.5 | 13.2 | 61 | thick tension coating |
| 12 | 0.25 | 18.5 | 11.8 | 64 | thick tension coating |

Figure 1:
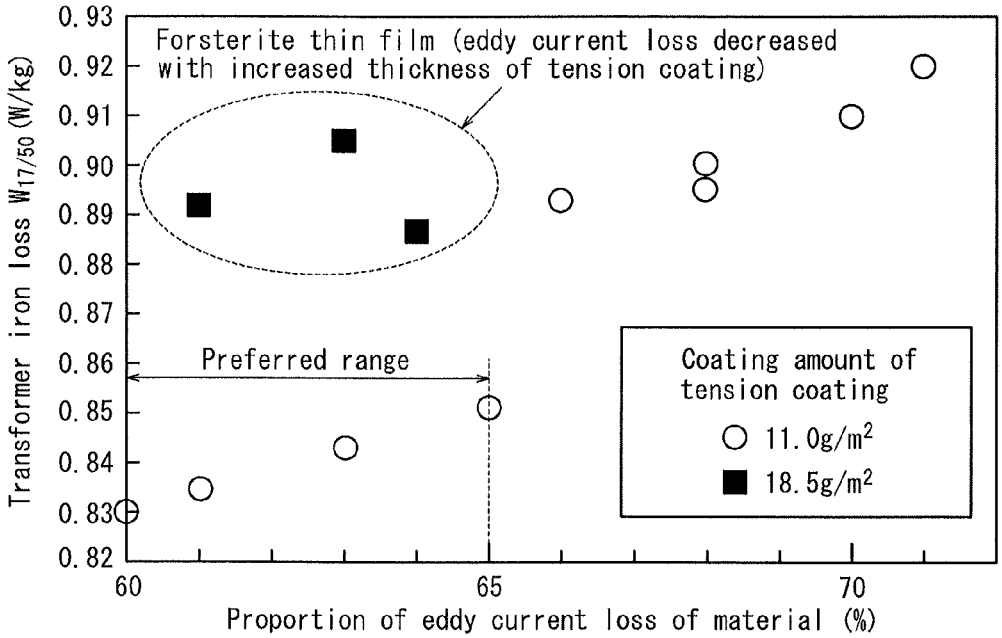
FIG. 1 is a graph illustrating change in transformer iron loss as a function of the proportion of eddy current loss of iron core material.

FIG. 1 illustrates change in transformer iron loss as a function of proportion of eddy current loss of iron core material. As indicated by white circles (coating amount of tension coating: 11.0 $g/m^2$), deterioration in building factor becomes less significant where the proportion of eddy current loss of material in the material iron loss is 65% or less.

On the other hand, as indicated by black rectangles (coating amount of tension coating: 18.5 $g/m^2$), there is no improvement in transformer iron loss where the thickness of the forsterite film is small, even if the proportion of eddy current loss is small.

In this case, to reduce the proportion of eddy current loss, it is effective to increase film tension in the rolling direction (total tension of the forsterite film and the tension coating), and as mentioned earlier, it is necessary to control this film tension to be 10.0 MPa or higher. However, as is the case with the examples indicated by black rectangles, it is believed that the stacking factor of the steel sheet becomes worse in the case of increasing the amount of tension coating to be applied so that the film tension is 10.0 MPa or higher, as compared to increasing the thickness of the forsterite film formed on the bottom portions of linear grooves and, therefore, the iron-loss improving effect is compensated by the increased coating film tension, which results in no improvement in transformer iron loss.

Accordingly, to improve the material iron loss property, it is important to control the thickness of the forsterite film formed on the bottom portions of linear grooves, while to improve the building factor, it is important to control the tension to be applied to the entire surfaces of the steel sheet including those portions where linear grooves are formed, the proportion of eddy current loss in material iron loss, and the thickness of the forsterite film formed on the bottom portions of linear grooves, respectively.

Based on these findings, specific conditions for balancing improvement of iron loss and improvement of building factor will be described below.

Sheet Thickness of Steel Sheet: 0.30 mm or Less

The sheet thickness of the steel sheet is 0.30 mm or less. This is because if the steel sheet has a sheet thickness exceeding 0.30 mm, it involves so large an eddy current loss that may prevent a reduction in the proportion of eddy current loss to 65% or less even with magnetic domain refinement. In addition, without limitation, the lower limit of the sheet thickness of the steel sheet is generally 0.05 mm or more.

Intervals in Rolling Direction Between Series of Linear Grooves Formed on Steel Sheet: 2 to 10 mm Intervals in the rolling direction between linear grooves formed on the steel sheet are 2 to 10 mm. This is because if the above-described intervals between series of linear grooves are above 10 mm, then a sufficient magnetic domain refining effect cannot be obtained due to a small magnetic charge introduced to the surfaces. On the other hand, if the intervals are below 2 mm, then the magnetic permeability in the rolling direction deteriorates and the effect of reducing eddy current loss by magnetic domain refinement is canceled due to an excessive increase in the magnetic charge introduced to the surfaces and a reduction in the amount of the steel substrate with an increasing number of grooves.

Depth of Linear Groove: 10 μm or More

The depth of each linear groove on the steel sheet is to be 10 μm or more. This is because if the depth of each linear groove on the steel sheet is below 10 μm, then a sufficient magnetic domain refining effect cannot be obtained due to a small magnetic charge introduced to the surfaces. It should be noted that the upper limit of the depth of each linear groove is preferably about 50 μm or less, without limitation, because the amount of the steel substrate is reduced with deeper grooves and thus magnetic permeability in the rolling direction becomes worse.

Thickness of Forsterite Film at Bottom Portion of Linear Groove: 0.3 μm or More

The effect attained by introducing linear grooves by the magnetic domain refining technique for forming linear grooves is smaller than the effect obtained by the magnetic domain refining technique for introducing a high dislocation density region because of a smaller magnetic charge being introduced. First, we investigated the magnetic charge introduced when linear grooves were formed. As a result, a correlation was found between the thickness of the forsterite film where linear grooves were formed, particularly at the bottom portions of the linear grooves, and the magnetic charge. Then, we further investigated the relationship between the thickness of the film and the magnetic charge. As a result, it was revealed that increasing the film thickness at the bottom portions of the linear grooves is effective to increase the magnetic charge.

Specifically, the thickness of the forsterite film that is necessary to increase the magnetic charge and improve the magnetic domain refining effect is 0.3 μm or more, preferably 0.6 μm or more, at the bottom portions of linear grooves. On the other hand, the upper limit of the thickness of the forsterite film is preferably about 5.0 μm without limitation, because the adhesion with the steel sheet deteriorates and the forsterite film comes off more easily if the forsterite film is too thick.

While the cause of an increase in the magnetic charge as described above has not been clarified exactly, we believe as follows. There is a correlation between the thickness of the forsterite film and the tension applied to the steel sheet by the forsterite film, and the film tension at the bottom portions of linear grooves becomes stronger with increasing thickness of the forsterite film. We believe that this increased tension causes an increase in internal stress of the steel sheet at the bottom portions of linear grooves, which results in an increase in the magnetic charge.

Figure 2:
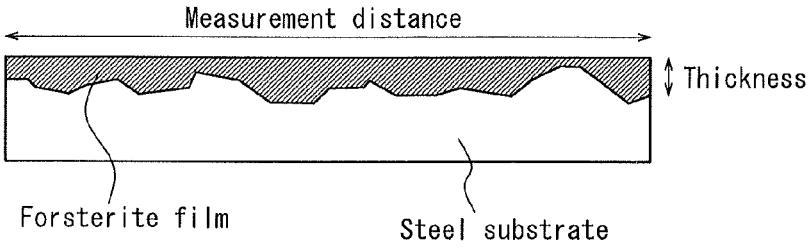
FIG. 2 is a cross-sectional view of a linear groove portion of a steel sheet.

The thickness of the forsterite film at the bottom portions of linear grooves is calculated as follows. As illustrated in FIG. 2, the forsterite film present at the bottom portions of linear grooves was observed with SEM in a cross-section taken along the direction in which the linear grooves extend, where the area of the forsterite film was calculated by image analysis and the calculated area was divided by a measurement distance to determine the thickness of the forsterite film of the steel sheet. In this case, the measurement distance was 100 mm.

When evaluating iron loss of a grain oriented electrical steel sheet as a product, the magnetizing flux only contains rolling directional components and, therefore, it is only necessary to increase tension in the rolling direction to improve the iron loss. However, when the grain oriented electrical steel sheet is assembled as an actual transformer, the magnetizing flux involves components not only in the rolling direction, but also in a direction perpendicular to the rolling direction (hereinafter, referred to as "transverse direction"). Accordingly, tension in the rolling direction as well as tension in the transverse direction have an influence on iron loss.

Total Tension Applied to Steel Sheet by Forsterite Film and Tension Coating: 10.0 MPa or Higher in Rolling Direction As mentioned above, deterioration in the iron loss property is unavoidable if the absolute value of tension applied to the steel sheet is small. Therefore, in the rolling direction of the steel sheet, it is necessary to control total tension applied by the forsterite film and the tension coating to be 10.0 MPa or higher. The reason why only total tension in the rolling direction is defined herein is because the tension applied in the transverse direction becomes large enough if a total tension of 10.0 MPa or higher is applied in the rolling direction. It should be noted that there is no particular upper limit on the total tension in the rolling direction as long as the steel sheet will not undergo plastic deformation. A preferable upper limit of the total tension is 200 MPa or lower.

The total tension exerted by the forsterite film and the tension coating is determined as follows.

When measuring tension in the rolling direction, a sample of 280 mm in the rolling direction×30 mm in the transverse direction is cut from the product (tension coating-applied material), whereas when measuring tension in the transverse direction, a sample of 280 mm in the transverse direction×30 mm in the rolling direction is cut from the product. Then, the forsterite film and the tension coating on one side is removed. Then, steel sheet warpage is determined by measuring warpage before and after removal and converted to tension using conversion formula (1) below. Tension determined by this method represents tension exerted on the surface from which the forsterite film and the tension coating have not been removed. Since tension is exerted on both sides of the sample, two samples were prepared to measure the same product in the same direction, and tension was determined for each side by the above-described method to derive an average value of the tension. This average value is considered as the tension exerted on the sample.

$$\sigma = \frac{Ed}{l^2}(a_2 - a_1) \qquad \text{Conversion Formula (1)}$$

where, σ: film tension (MPa)

E: Young's modulus of steel sheet=143 (GPa)

L: warpage measurement length (mm)

$a_1$: warpage before removal (mm)

$a_2$: warpage after removal (mm)

d: steel sheet thickness (mm).

Proportion of eddy current loss in iron loss $W_{17/50}$ of a steel sheet when alternating magnetic field of 1.7 T and 50 Hz is applied to the steel sheet in rolling direction: 65% or less.

A proportion of eddy current loss in iron loss $W_{17/50}$ of the steel sheet is controlled to be 65% or less when an alternating magnetic field of 1.7 T and 50 Hz is applied to the steel sheet in the rolling direction. This is because, as mentioned above, if the proportion of eddy current loss exceeds 65%, the resulting steel sheet has increased iron loss when assembled as a transformer even if the steel sheet, in itself, shows no change in the value of iron loss.

In other words, this is because when a grain oriented electrical steel sheet is assembled as the iron core of an actual transformer, high-harmonic components are superimposed on the magnetic flux and eddy current loss increases, which increases depending on the frequency in the iron core of the transformer and, therefore, the transformer experiences an increase in iron loss. Such an increase in eddy current loss of the transformer is proportional to the eddy current loss of the original steel sheet. Thus, it is possible to reduce the iron loss of the resulting transformer by reducing the proportion of eddy current loss in the steel sheet. Accordingly, the proportion of eddy current loss in iron loss $W_{17/50}$ of the steel sheet is controlled to 65% or less when an alternating magnetic field of 1.7 T and 50 Hz is applied to the steel sheet in the rolling direction.

Material iron loss $W_{17/50}$ (total iron loss) was measured using a single sheet tester in accordance with JIS C2556. In addition, measurements were made on a hysteresis B-H loop of the same sample as used in the measurements of material iron loss by direct current magnetization (0.01 Hz or less) at maximum magnetic flux of 1.7 T and minimum magnetic flux of −1.7 T, where iron loss as calculated from one cycle of the B-H loop was considered as hysteresis loss. On the other hand, eddy current loss was calculated by subtracting hysteresis loss obtained by direct current magnetization measurements from material iron loss (total iron loss). The obtained value of eddy current loss was divided by the value of material iron loss and expressed in percentage, which was considered as the proportion of eddy current loss in material iron loss.

A method for manufacturing a grain oriented electrical steel sheet will be specifically described below.

First, the method involves forming a forsterite film at the bottom portions of linear grooves as well, with a thickness of 0.3 μm or more. Therefore, it is essential to form linear grooves prior to final annealing whereby a forsterite film is formed. Additionally, to form a forsterite film having the above-described thickness at the bottom portions of the linear grooves, the coating amount of an annealing separator should be 10 g/m$^2$ or more in total of both surfaces. In addition, there is no particular upper limit to the coating amount of the annealing separator, without interfering with the manufacturing process (such as causing weaving of the coil during the final annealing). If any inconvenience such as the above-described weaving is caused, it is preferable that the coating amount is 50 g/m$^2$ or less.

Second, the method involves increasing tension applied to the steel sheet (both in a rolling direction and a transverse direction perpendicular to the rolling direction). An important thing is to reduce destruction of the forsterite film where linear grooves are formed, particularly at the bottom portions of the linear grooves, in a flattening annealing line after the final annealing by tensile stress applied to the steel sheet in the rolling direction in a furnace at high temperature.

To reduce destruction of the forsterite film where linear grooves are formed in performing tension coating and flattening annealing, tension applied to the steel sheet in a flattening annealing line after the final annealing is 3 to 15 MPa. The reason for this is as follows.

In the flattening annealing line after the final annealing, a large tension is applied in the direction of conveyance of the steel sheet to flatten the sheet shape. Particularly, portions where linear grooves are formed are susceptible to stress concentration due to their shape, where the forsterite film is prone to destruction. Accordingly, to mitigate the damage to the forsterite film, it is effective to reduce tension applied to the steel sheet. This is because reducing the applied tension results in less stress applied to the steel sheet and therefore less possibility of destruction of the forsterite film at the bottom portions of the linear grooves. However, if the applied tension is too small, sheet meandering and shaping failure may occur in the flattening annealing line, which results in a decrease in productivity. Accordingly, an optimum range of tension to be applied to the steel sheet is 3 to 15 MPa to prevent destruction of the forsterite film and maintain the productivity of line in the flattening annealing line.

Although there are no particular limitations other than the above-described points, recommended and preferred chemical compositions of and conditions for manufacturing the steel sheet will be described below. In addition, the higher the degree of the crystal grain alignment in the <100> direction, the greater the effect of reducing the iron loss obtained by magnetic domain refinement. It is thus preferable that a magnetic flux density $B_8$, which gives an indication of the degree of the crystal grain alignment, is 1.90 T or higher.

In addition, if an inhibitor, e.g., an AlN-based inhibitor is used, Al and N may be contained in an appropriate amount, respectively, while if a MnS/MnSe-based inhibitor is used, Mn and Se and/or S may be contained in an appropriate amount, respectively. Of course, these inhibitors may also be used in combination. In this case, preferred contents of Al, N, S and Se are: Al: 0.01 to 0.065 mass %; N: 0.005 to 0.012 mass %; S: 0.005 to 0.03 mass %; and Se: 0.005 to 0.03 mass %, respectively.

Further, our grain oriented electrical steel sheet may have limited contents of Al, N, S and Se without using an inhibitor. In this case, the contents of Al, N, S and Se are preferably limited to Al: 100 mass ppm or less, N: 50 mass ppm or less, S: 50 mass ppm or less, and Se: 50 mass ppm or less, respectively.

The basic elements and other optionally added elements of the slab for a grain oriented electrical steel sheet will be specifically described below.

C: 0.08 Mass % or Less

C is added to improve the texture of a hot-rolled sheet. However, C content exceeding 0.08 mass % increases the burden to reduce C content to 50 mass ppm or less where magnetic aging will not occur during the manufacturing process. Thus, C content is preferably 0.08 mass % or less. Besides, it is not necessary to set a particular lower limit to C content because secondary recrystallization is enabled by a material without containing C.

Si: 2.0 to 8.0 Mass %

Si is an element useful to increase electrical resistance of steel and improve iron loss. Si content of 2.0 mass % or more has a particularly good effect in reducing iron loss. On the other hand, Si content of 8.0 mass % or less may offer particularly good workability and magnetic flux density. Thus, Si content is preferably 2.0 to 8.0 mass %.

Mn: 0.005 to 1.0 Mass %

Mn is an element advantageous to improve hot workability. However, Mn content less than 0.005 mass % has a less addition effect. On the other hand, Mn content of 1.0 mass % or less provides a particularly good magnetic flux density to the product sheet. Thus, Mn content is preferably 0.005 to 1.0 mass %.

Further, in addition to the above elements, the slab may also contain the following elements as elements to improve magnetic properties:

at least one element selected from: Ni: 0.03 to 1.50 mass %; Sn: 0.01 to 1.50 mass %; Sb: 0.005 to 1.50 mass %; Cu: 0.03 to 3.0 mass %; P: 0.03 to 0.50 mass %; Mo: 0.005 to 0.10 mass %; and Cr: 0.03 to 1.50 mass %.

Ni is an element useful to further improve the texture of a hot-rolled sheet to obtain even more improved magnetic properties. However, Ni content of less than 0.03 mass % is less effective in improving magnetic properties, whereas Ni content of 1.50 mass % or less increases, in particular, the stability of secondary recrystallization and provides even more improved magnetic properties. Thus, Ni content is preferably 0.03 to 1.50 mass %.

In addition, Sn, Sb, Cu, P, Mo and Cr are elements useful to further improve the magnetic properties, respectively. However, if any of these elements is contained in an amount less than its lower limit described above, it is less effective in improving the magnetic properties, whereas if contained in an amount equal to or less than its upper limit described above, it gives the best growth of secondary recrystallized grains. Thus, each of these elements is preferably contained in an amount within the above-described range. The balance other than the above-described elements is Fe and incidental impurities incorporated during the manufacturing process.

Then, the slab having the above-described chemical composition is subjected to heating before hot rolling in a conventional manner. However, the slab may also be subjected to hot rolling directly after casting, without being subjected to heating. In the case of a thin slab, it may be subjected to hot rolling or proceed to the subsequent step, omitting hot rolling.

Further, the hot rolled sheet is optionally subjected to hot band annealing. A main purpose of hot band annealing is to improve the magnetic properties by dissolving the band texture generated by hot rolling to obtain a primary recrystallization texture of uniformly-sized grains, and thereby further developing a Goss texture during secondary recrystallization annealing. As this moment, to obtain a highly-developed Goss texture in a product sheet, a hot band annealing temperature is preferably 800° C. to 1100° C. If a hot band annealing temperature is lower than 800° C., there remains a band texture resulting from hot rolling, which makes it difficult to obtain a primary recrystallization texture of uniformly-sized grains and impedes a desired improvement of secondary recrystallization. On the other hand, if a hot band annealing temperature exceeds 1100° C., the grain size after the hot band annealing coarsens too much, which makes it difficult to obtain a primary recrystallization texture of uniformly-sized grains.

After hot band annealing, the sheet is subjected to cold rolling once, or twice or more with intermediate annealing performed therebetween, followed by decarburization (combined with recrystallization annealing) and application of an annealing separator to the sheet. After application of the annealing separator, the sheet is subjected to final annealing for purposes of secondary recrystallization and formation of a forsterite film. It should be noted that the annealing separator is preferably composed mainly of MgO in order to form forsterite. As used herein, the phrase "composed mainly of MgO" implies that any well-known compound for the annealing separator and any property-improving compound other than MgO may also be contained within a range without interfering with the formation of a forsterite film intended by the invention. In addition, as described later, formation of linear grooves is performed in any step after final cold rolling and before final annealing.

After final annealing, it is effective to subject the sheet to flattening annealing to correct its shape. Insulating coating is applied to the surfaces of the steel sheet before or after flattening annealing. As used herein, this insulating coating means such a coating that may apply tension to the steel sheet to reduce iron loss. Tension coating includes inorganic coating containing silica and ceramic coating by physical vapor deposition, chemical vapor deposition, and so on.

Linear grooves are formed on a surface of the grain oriented electrical steel sheet in any step after the above-described final cold rolling and before final annealing. At this moment, the proportion of eddy current loss in material iron loss is controlled by controlling the thickness of the forsterite film at the bottom portions of linear grooves and by controlling the total tension applied in the rolling direction by the forsterite film and the tension coating film as mentioned above. This leads to a more significant effect of improving iron loss property through magnetic domain refinement in which linear grooves are formed, whereby a sufficient effect of magnetic domain refinement is obtained.

Linear grooves are formed by different methods including conventionally well-known methods for forming linear grooves, e.g., a local etching method, scribing method using cutters or the like, rolling method using rolls with projections, and so on. The most preferable method is a method including adhering, by printing or the like, etching resist to a steel sheet after being subjected to final cold rolling, and then forming linear grooves on a non-adhesion region of the steel sheet through a process such as electrolysis etching.

It is preferred that linear grooves are formed on a surface of the steel sheet, with a depth of 10 μm or more, up to about 50 μm, and a width of about 50 to 300 μm, at intervals of 2 to 10 mm, where the linear grooves are formed at an angle in the range of ±30° relative to a direction perpendicular to the rolling direction. As used herein, "linear" is intended to encompass a solid line as well as a dotted line, dashed line, and so on.

Except the above-mentioned steps and manufacturing conditions, a conventionally well-known method for manufacturing a grain oriented electrical steel sheet may be applied where magnetic domain refining treatment is performed by forming linear grooves.

EXAMPLES

Example 1

Steel slabs, each having the chemical composition as shown in Table 2, were manufactured by continuous casting. Each of these steel slabs was heated to 1400° C., subjected to hot rolling to be finished to a hot-rolled sheet having a sheet thickness of 2.2 mm, and then subjected to hot band annealing at 1020° C. for 180 seconds. Subsequently, each steel sheet was subjected to cold rolling to an intermediate sheet thickness of 0.55 mm, and then to intermediate annealing under the following conditions: degree of atmospheric oxidation $P(H_2O)/P(H_2)=0.25$, and duration=90 seconds. Subsequently, each steel sheet was subjected to hydrochloric acid pickling to remove subscales from the surfaces thereof, followed by cold rolling again to be finished to a cold-rolled sheet having a sheet thickness of 0.23 mm.

TABLE 2

| | Chemical Composition [mass %] (C, O, N, Al, Se, S: [mass ppm]) | | | | | | | | |
|---|---|---|---|---|---|---|---|---|---|
| Steel ID | C | Si | Mn | Ni | O | N | Al | Se | S |
| A | 450 | 3.25 | 0.04 | 0.01 | 16 | 70 | 230 | tr | 20 |
| B | 550 | 3.30 | 0.11 | 0.01 | 15 | 25 | 30 | 100 | 30 |
| C | 700 | 3.20 | 0.09 | 0.01 | 12 | 80 | 200 | 90 | 30 |
| D | 250 | 3.05 | 0.04 | 0.01 | 25 | 40 | 60 | tr | 20 |

balance: Fe and incidental impurities

Thereafter, each steel sheet was applied with etching resist by gravure offset printing. Then, each steel sheet was subjected to electrolysis etching and resist stripping in an alkaline solution, whereby linear grooves, each having a width of 150 μm and depth of 20 μm, were formed at intervals of 3 mm at an inclination angle of 10° relative to a direction perpendicular to the rolling direction.

Then, each steel sheet was subjected to decarburization where it was held at a degree of atmospheric oxidation $P(H_2O)/P(H_2)=0.55$ and a soaking temperature of 825° C. for 200 seconds. Then, an annealing separator composed mainly of MgO was applied to each steel sheet. Thereafter, each steel sheet was subjected to final annealing for the purposes of secondary recrystallization and purification under the conditions of 1250° C. and 10 hours in a mixed atmosphere of $N_2:H_2=60:40$.

Then, insulating tension coating composed of 50% colloidal silica and magnesium phosphate was applied to each steel sheet to be finished to a product. In this case, various types of insulation tension coating were applied to the steel sheets and several different tensions were applied to the coils in the continuous line after the final annealing.

Additionally, other products were also produced as comparative examples where linear grooves were formed in each product after the final annealing and insulating tension coating composed of 50% colloidal silica and magnesium phosphate was applied to each product. Manufacturing conditions were the same as described above, except the timing of formation of linear grooves. Then, each product was measured for its magnetic properties and film tension, and furthermore, sheared into specimens having bevel edges to be assembled into a three-phase transformer at 500 kVA, and then measured for its iron loss and noise in a state where it was excited at 50 Hz and 1.7 T.

The above-described measurement results are shown in Table 3.

TABLE 3

| No. | Steel ID | Groove Formation Timing | Amount Of Annealing Separator Applied ($g/m^2$) | Tension Applied In Flattening Annealing (MPa) | Thickness Of Forsterite Film at Bottom Portions of Grooves (μm) | Film Tension In Rolling Direction (MPa) | Proportion of Eddy Current Loss (%) | Material Iron Loss $W_{17/50}$ (W/kg) | Transformer Iron Loss $W_{17/50}$ (W/kg) | Building Factor | Others | Remarks |
|---|---|---|---|---|---|---|---|---|---|---|---|---|
| 1 | A | After Cold Rolling | 11 | 17.7 | 0.13 | 9.2 | 68 | 0.75 | 1.00 | 1.33 | — | Comparative Example |
| 2 | | After Cold Rolling | 8 | 8.8 | 0.11 | 8.8 | 70 | 0.77 | 1.03 | 1.34 | — | Comparative Example |
| 3 | | After Cold Rolling | 11 | 6.9 | 0.36 | 12.3 | 62 | 0.73 | 0.90 | 1.23 | — | Conforming Example |
| 4 | | After Final Annealing | 11 | 8.8 | 0.02 | 9.9 | 68 | 0.78 | 1.03 | 1.32 | — | Comparative Example |
| 5 | B | After Cold Rolling | 12 | 14.7 | 0.32 | 13.2 | 64 | 0.72 | 0.90 | 1.25 | — | Conforming Example |
| 6 | | After Cold Rolling | 12 | 2.0 | — | — | — | — | — | — | Sheet meandering occurred, not available as a product | Comparative Example |
| 7 | | After Cold Rolling | 12 | 4.9 | 0.61 | 14.2 | 63 | 0.70 | 0.87 | 1.24 | — | Conforming Example |
| 8 | | After Cold Rolling | 12 | 6.9 | 0.52 | 13.8 | 62 | 0.71 | 0.88 | 1.24 | — | Conforming Example |
| 9 | | After Cold Rolling | 7 | 9.8 | 0.18 | 8.8 | 66 | 0.78 | 1.02 | 1.31 | — | Comparative Example |
| 10 | | After Final Annealing | 12 | 3.0 | 0.08 | 11.2 | 69 | 0.75 | 1.00 | 1.33 | — | Comparative Example |
| 11 | C | After Cold Rolling | 14 | 4.9 | 0.68 | 16.2 | 59 | 0.67 | 0.82 | 1.22 | — | Conforming Example |
| 12 | | After Cold Rolling | 14 | 8.8 | 0.52 | 15.2 | 62 | 0.69 | 0.84 | 1.22 | — | Conforming Example |
| 13 | | After Cold Rolling | 14 | 12.7 | 0.48 | 15.0 | 63 | 0.68 | 0.85 | 1.25 | — | Conforming Example |
| 14 | | After Cold Rolling | 14 | 15.7 | 0.22 | 10.2 | 68 | 0.75 | 0.99 | 1.32 | — | Comparative Example |
| 15 | | After Final Annealing | 11 | 12.7 | 0.02 | 9.0 | 70 | 0.79 | 1.06 | 1.34 | — | Comparative Example |
| 16 | D | After Cold Rolling | 12 | 2.0 | 0.35 | 12.3 | 60 | 0.82 | 1.12 | 1.37 | shaping failure | Comparative Example |
| 17 | | After Cold Rolling | 12 | 10.8 | 0.52 | 13.6 | 61 | 0.71 | 0.86 | 1.21 | — | Conforming Example |

As shown in Table 3, each grain oriented electrical steel sheet was subjected to magnetic domain refining treatment by forming linear grooves so that it had a tension within our range is less susceptible to deterioration in its building factor and offers extremely good iron loss properties. In contrast, grain oriented electrical steel sheets using Comparative Examples indicated by Nos. 1, 2, 4, 9, 10, 14, 15 and 16, any of the features of which is out of our range such as the thickness of the forsterite film at the bottom portions of linear grooves, fail to provide low iron loss properties and suffer deterioration in its building factor as actual transformers.

The invention claimed is:

1. A grain oriented electrical steel sheet comprising: a forsterite film, a tension coating on a surface of the steel sheet, and linear grooves for magnetic domain refinement on a surface of the steel sheet, wherein the steel sheet has a sheet thickness of 0.30 mm or less, the linear grooves are located at intervals of 2 to 10 mm in a rolling direction, depth of each of the linear grooves is 10 μm or more, thickness of the forsterite film at bottom portions of the linear grooves is 0.3 μm or more, total tension applied to the steel sheet by the forsterite film and the tension coating is 10.0 MPa or higher in the rolling direction, and a proportion of eddy current loss in iron loss $W_{17/50}$ of the steel sheet is 65% or less when an alternating magnetic field of 1.7 T and 50 Hz is applied to the steel sheet in the rolling direction.

* * * * *